US006061841A

United States Patent [19]

Parviainen et al.

[11] Patent Number: 6,061,841

[45] Date of Patent: May 16, 2000

[54] SANITARY TOILET SEAT COVER

[76] Inventors: Pirjo Parviainen; Risto Parviainen, both of 9340 Lagoon Pl. #309, Fort Lauderdale, Fla. 33324

[21] Appl. No.: 09/146,110

[22] Filed: Sep. 3, 1998

[51] Int. Cl.[7] ..... A47K 13/16

[52] U.S. Cl. ..... 4/245.9; 4/245.1; 4/245.8

[58] Field of Search ..... 4/245.9, 245.8, 4/245.1, 300.3, 315

[56] References Cited

FOREIGN PATENT DOCUMENTS

| | | | |
|---|---|---|---|
| 349468 | 1/1990 | European Pat. Off. | 4/245.9 |
| 442324 | 8/1912 | France | 4/245.1 |
| 2618062 | 1/1989 | France | 4/245.1 |
| 2026235 | 4/1971 | Germany | 4/245.9 |
| 5601 | of 1906 | United Kingdom | 4/245.9 |
| 227413 | 7/1925 | United Kingdom | 4/245.9 |

*Primary Examiner*—Henry J. Recla
*Assistant Examiner*—Kathleen J. Prunner

[57] ABSTRACT

A sanitary toilet seat cover is provided for covering a toilet seat and preventing splashing on to the user from water in the toilet bowl. The sanitary toilet seat cover includes a flexible sheet in a generally conical configuration having a generally circular outer perimeter and a center vertex. The outer perimeter of the sheet is adapted for draping around the perimeter of a toilet seat such that the sheet substantially covers the toilet seat and the center vertex of the sheet extends into the toilet bowl.

11 Claims, 2 Drawing Sheets

SANITARY TOILET SEAT COVER

BACKGROUND OF THE INVENTION

1. Field of the Invention

The present invention relates to sanitary toilet seat covers and more particularly pertains to a new sanitary toilet seat cover for covering a toilet seat and preventing splashing on to the user from water in the toilet bowl.

2. Description of the Prior Art

The use of sanitary toilet seat covers is known in the prior art. More specifically, sanitary toilet seat covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art sanitary toilet seat covers include U.S. Pat. No. 4,975,990; U.S. Pat. No. 5,323,495; U.S. Pat. No. 3,851,341; U.S. Pat. No. 2,139,003; U.S. Pat. No. 2,025,941; and U.S. Pat. No. Des. 356,634.

While these devices fulfill their respective, particular objectives and requirements, the aforementioned patents do not disclose a new sanitary toilet seat cover. The inventive device includes a flexible sheet in a generally conical configuration having a generally circular outer perimeter and a center vertex. The outer perimeter of the sheet is adapted for draping around the perimeter of a toilet seat such that the sheet substantially covers the toilet seat and the center vertex of the sheet extends into the toilet bowl.

In these respects, the sanitary toilet seat cover according to the present invention substantially departs from the conventional concepts and designs of the prior art, and in so doing provides an apparatus primarily developed for the purpose of covering a toilet seat and preventing splashing on to the user from water in the toilet bowl.

SUMMARY OF THE INVENTION

In view of the foregoing disadvantages inherent in the known types of sanitary toilet seat covers now present in the prior art, the present invention provides a new sanitary toilet seat cover construction wherein the same can be utilized for covering a toilet seat and preventing splashing on to the user from water in the toilet bowl.

The general purpose of the present invention, which will be described subsequently in greater detail, is to provide a new sanitary toilet seat cover apparatus and method which has many of the advantages of the sanitary toilet seat covers mentioned heretofore and many novel features that result in a new sanitary toilet seat cover which is not anticipated, rendered obvious, suggested, or even implied by any of the prior art sanitary toilet seat covers, either alone or in any combination thereof.

To attain this, the present invention generally comprises a flexible sheet in a generally conical configuration having a generally circular outer perimeter and a center vertex. The outer perimeter of the sheet is adapted for draping around the perimeter of a toilet seat such that the sheet substantially covers the toilet seat and the center vertex of the sheet extends into the toilet bowl.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sanitary toilet seat cover apparatus and method which has many of the advantages of the sanitary toilet seat covers mentioned heretofore and many novel features that result in a new sanitary toilet seat cover which is not anticipated, rendered obvious, suggested, or even implied by any of the prior art sanitary toilet seat covers, either alone or in any combination thereof.

It is another object of the present invention to provide a new sanitary toilet seat cover which may be easily and efficiently manufactured and marketed.

It is a further object of the present invention to provide a new sanitary toilet seat cover which is of a durable and reliable construction.

An even further object of the present invention is to provide a new sanitary toilet seat cover which is susceptible of a low cost of manufacture with regard to both materials and labor, and which accordingly is then susceptible of low prices of sale to the consuming public, thereby making such sanitary toilet seat cover economically available to the buying public.

Still yet another object of the present invention is to provide a new sanitary toilet seat cover which provides in the apparatuses and methods of the prior art some of the advantages thereof, while simultaneously overcoming some of the disadvantages normally associated therewith. Still another object of the present invention is to provide a new sanitary toilet seat cover for covering a toilet seat and preventing splashing on to the user from water in the toilet bowl.

Yet another object of the present invention is to provide a new sanitary toilet seat cover which includes a flexible sheet in a generally conical configuration having a generally circular outer perimeter and a center vertex. The outer perimeter of the sheet is adapted for draping around the perimeter of a toilet seat such that the sheet substantially covers the toilet seat and the center vertex of the sheet extends into the toilet bowl.

Still yet another object of the present invention is to provide a new sanitary toilet seat cover that may be used to cover public toilets and other toilets where the cleanliness of the toilet is in question to protect the user from germs on the toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
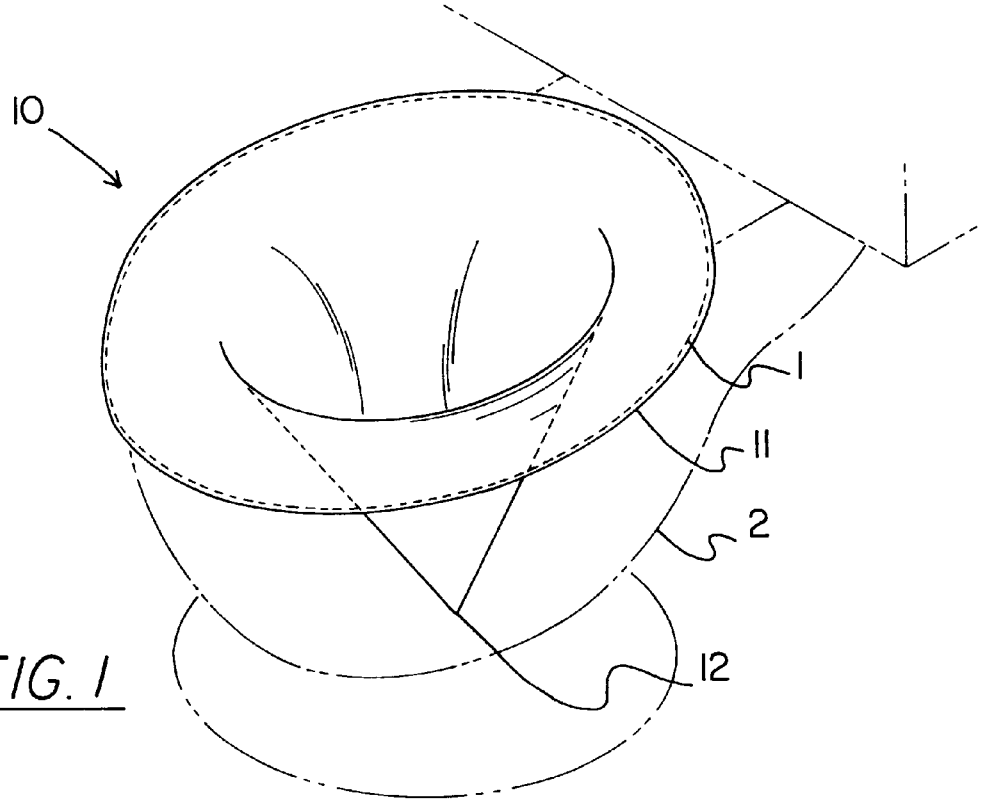
FIG. 1 is a schematic perspective view of a new sanitary toilet seat cover in use on a toilet seat according to the present invention.
Figure 2:
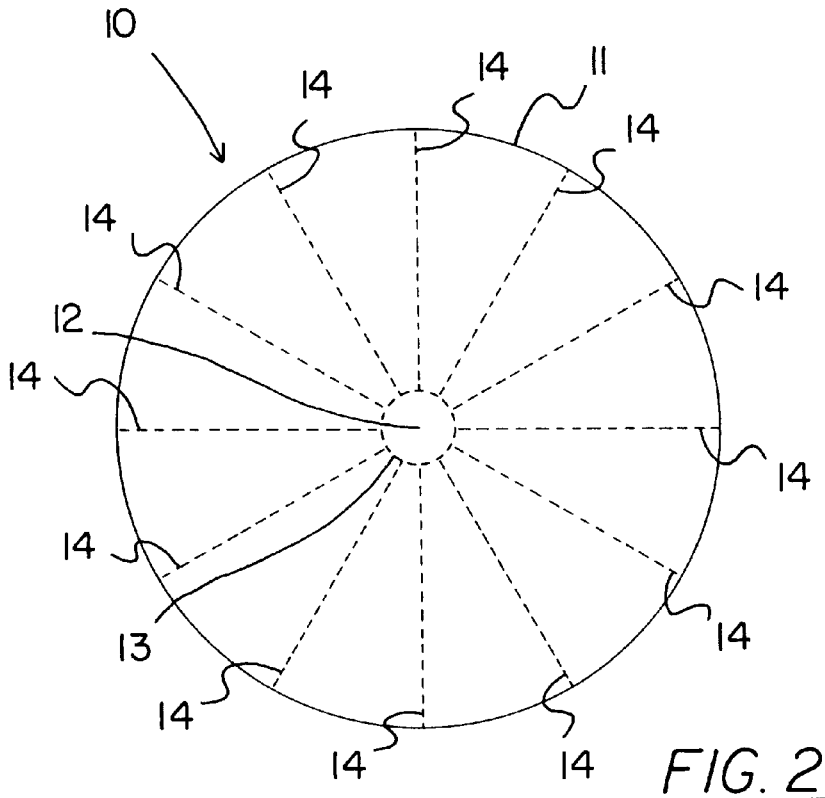
FIG. 2 is a schematic top plan view of the present invention.

With reference now to the drawings, and in particular to FIGS. 1 through 4 thereof, a new sanitary toilet seat cover embodying the principles and concepts of the present invention will be described.

As best illustrated in FIGS. 1 through 4, the sanitary toilet seat cover generally comprises a flexible sheet 10 in a generally conical configuration having a generally circular outer perimeter 11 and a center vertex 12. The outer perimeter 11 of the sheet 10 is adapted for draping around the perimeter of a toilet seat 1 such that the sheet 10 substantially covers the toilet seat 1 and the center vertex 12 of the sheet 10 extends into the toilet bowl 2.

In closer detail, the flexible sheet 10 is shaped in a generally conical configuration having a generally circular outer perimeter 11 and a center vertex 12. Preferably, the sheet 10 has an axis extending though the center vertex 12 and the center of the outer perimeter 11. The sheet 10 has a slope or angle of incline with respect to the axis of the sheet 10 between about 30° and about 60°. The sheet 10 preferably comprises a material that may be easily flushed down the drain of a toilet without clogging the drain. Ideally, the sheet 10 comprises a paper material such as waxed paper or a flexible biodegradable plastic material, or a plastic-like material composed of shrimp shells. With reference to FIG. 1, the outer perimeter 11 of the sheet 10 has a diameter of a sufficient size to permit draping of the outer perimeter 11 of the sheet 10 around the perimeter of a toilet seat 1 such that a ring-shaped portion of the sheet 10 adjacent the outer perimeter 11 of the sheet 10 substantially covers the toilet seat 1 and the vertex of the sheet 10 is extended into the toilet bowl.

The sheet 10 preferably has a plurality of generally straight separation lines 14 extending radially between the center vertex 12 and outer perimeter 11 of the sheet 10. The sheet 10 is separable along each of the generally straight separation lines 14 so that the sheet 10 can be separated in smaller pieces after use for easier flushing down the toilet. Ideally, the sheet 10 has a plurality of spaced apart apertures (preferably perforations) therethrough along each of the generally straight separation lines 14 to aid separation of the sheet 10 along the generally straight separation lines 14.

Figure 3:
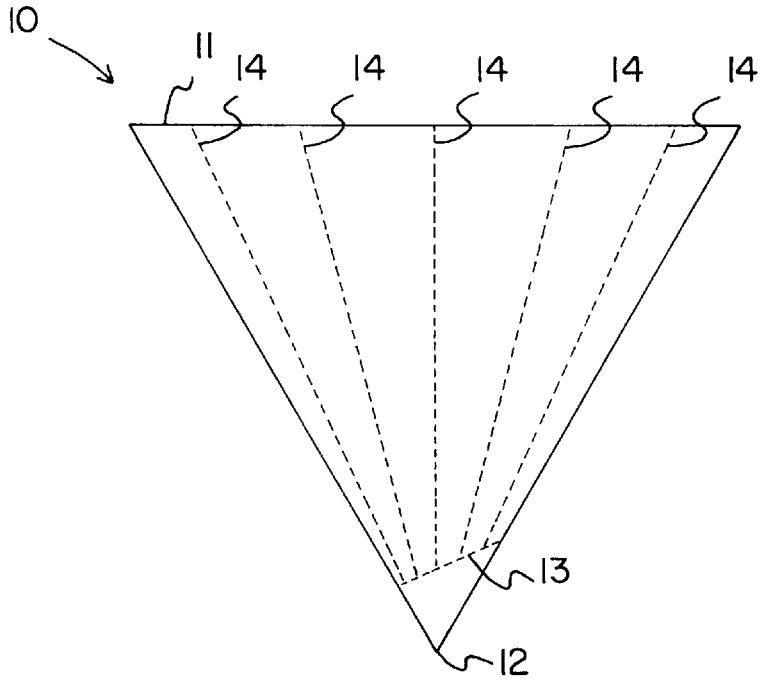
FIG. 3 is a schematic side view of the present invention.
Figure 4:
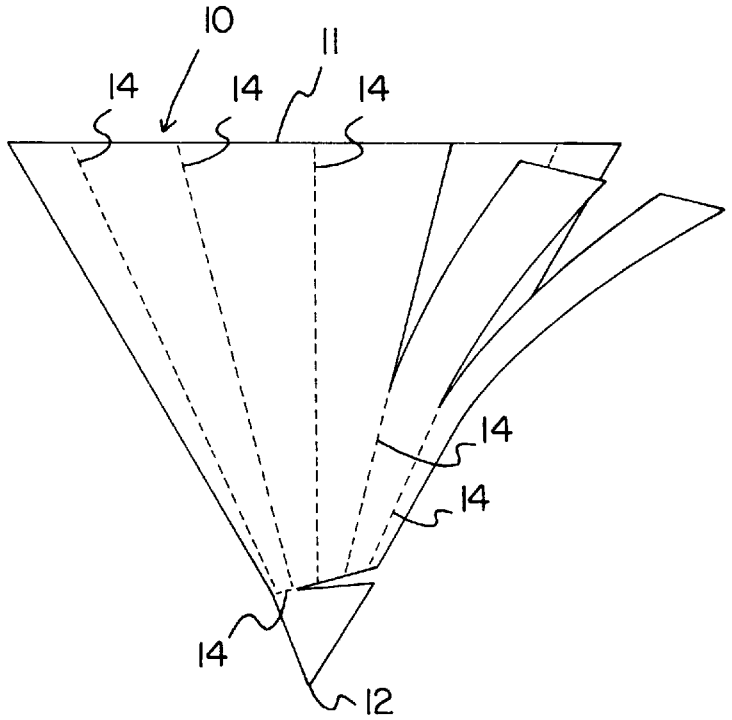
FIG. 4 is a schematic side view of the present invention illustrating the separation of the sheet along the separation lines.

In an ideal optional embodiment, the sheet 10 has an annular separation line 13 extending therearound. The annular separation line 13 is located towards the center vertex 12 of the sheet 10. In this embodiment, the generally straight separation lines 14 extend radially outwards from annular separation line 13 towards the outer perimeter 11 of the sheet 10 as illustrated in FIG. 3. Preferably, the annular separation line 13 lies in a plane extending at an acute angle to the axis of the sheet 10. Like the generally straight separation lines, the sheet 10 is separable along the annular separation line 13 to form a generally circular opening through the sheet 10. The sheet 10 ideally has a plurality of spaced apart apertures (preferably perforations) therethrough along the annular separation line 13 to aid separation of the sheet 10 along the annular separation line 13. In use, the sheet 10 may be separated along the annular separation line 13 before placing the sheet 10 on the toilet seat 1 such that the opening is located in the toilet bowl.

In use, the outer perimeter 11 of the sheet 10 is draped over the outside of the toilet seat 1 so that the sheet 10 substantially covers the top of the toilet seat 1 and the center vertex 12 extends down into the toilet bowl. Optionally, before placing on the toilet seat 1, the sheet 10 may be separated along the annular separation line 13 to form an opening through the sheet 10 which will be located in the toilet bowl when the sheet 10 is draped on the toilet seat 1. After the user is finished using the toilet, the sheet 10 may be flushed down the toilet drain with or without separating the sheet 10 along the generally straight separation lines 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sanitary toilet seat cover, comprising:

a flexible sheet in a generally conical configuration having a generally circular outer perimeter and a center vertex;

said outer perimeter of said sheet being adapted for draping around the perimeter of a toilet seat such that said sheet substantially covers the toilet seat and said center vertex of said sheet is extended into the toilet bowl;

wherein said sheet has an annular separation line extending therearound, said annular separation line being located towards said center vertex of said sheet, said sheet being separable along said annular separation line to form an opening through said sheet; and wherein said sheet has an axis extending though said center vertex and a center of said outer perimeter, said axis being perpendicular to a plane in which the outer perimeter of the flexible sheet lies, wherein said annular separation line lies in a plane skewed to said plane in which said outer perimeter of said flexible sheet lies whereby said flexible sheet is adapted such that a perpendicular length between said outer perimeter and said annular separation line on one side is greater than a perpendicular length between said outer perimeter and said annular separation line on a side opposite said one side.

2. The sanitary toilet seat of claim 1, wherein said sheet has a plurality of generally straight separation lines extending radially outwards between said center vertex and outer perimeter of said sheet, said sheet being separable along each of said generally straight separation lines.

3. The sanitary toilet seat cover of claim 2, wherein said sheet comprises a material that may be easily flushed down the drain of said toilet without clogging the drain.

4. The sanitary toilet seat of claim 3, wherein said sheet comprises a paper material.

5. The sanitary toilet seat of claim 2, wherein said outer perimeter of said sheet has a diameter of a sufficient size to permit draping of said outer perimeter of said sheet around the perimeter of said toilet seat such that said sheet substantially covers the toilet seat.

6. The sanitary toilet seat of claim 2, wherein said sheet has a plurality of spaced apart apertures therethrough along said annular separation line to aid separation of said sheet along said annular separation line.

7. The sanitary toilet seat cover of claim 1, wherein said sheet comprises a material that may be easily flushed down the drain of said toilet without clogging the drain.

8. The sanitary toilet seat of claim 7, wherein said sheet comprises a paper material.

9. The sanitary toilet seat of claim 1, wherein said outer perimeter of said sheet has a diameter of a sufficient size to permit draping of said outer perimeter of said sheet around the perimeter of said toilet seat such that said sheet substantially covers the toilet seat.

10. The sanitary toilet seat of claim 1, wherein said sheet has a plurality of spaced apart apertures therethrough along said annular separation line to aid separation of said sheet along said annular separation line.

11. A sanitary toilet seat cover, comprising:

a flexible sheet in a generally conical configuration having a generally circular outer perimeter and a center vertex;

said sheet having an axis extending though said center vertex and a center of said outer perimeter;

said sheet comprising a material that may be easily flushed down the drain of a toilet without clogging the drain, wherein said sheet comprises a paper material;

said outer perimeter of said sheet having a diameter of a sufficient size to permit draping of said outer perimeter of said sheet around the perimeter of a toilet seat such that said sheet substantially covers the toilet seat and said center vertex of said sheet is extended into the toilet bowl;

said sheet having an annular separation line extending therearound, said annular separation line being located towards said center vertex of said sheet, said annular separation line lying in a plane extending at an acute angle to said axis of said sheet;

said sheet being separable along said annular separation line to form an opening through said sheet, said sheet having a plurality of spaced apart apertures therethrough along said annular separation line to aid separation of said sheet along said annular separation line;

said sheet having a plurality of generally straight separation lines extending radially outwards from said annular separation line towards said outer perimeter of said sheet; and said sheet being separable along each of said generally straight separation lines, said sheet having a plurality of spaced apart apertures therethrough along each of said generally straight separation lines to aid separation of said sheet along said generally straight separation lines.

* * * * *